US008157711B2

(12) United States Patent
Towley, III et al.

(10) Patent No.: US 8,157,711 B2
(45) **Date of Patent: *Apr. 17, 2012**

(54) SELECTORIZED DUMBBELL USING COMMODITY WEIGHTS

(75) Inventors: Carl K. Towley, III, Alexandria, MN (US); Gregory S. Olson, Owatonna, MN (US)

(73) Assignee: Power Block Holdings, Inc., Owatonna, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/786,662

(22) Filed: May 25, 2010

(65) Prior Publication Data

US 2010/0323855 A1 Dec. 23, 2010

Related U.S. Application Data

(63) Continuation of application No. 12/214,265, filed on Jun. 17, 2008, now Pat. No. 7,722,511, which is a continuation of application No. 11/644,061, filed on Dec. 22, 2006, now Pat. No. 7,387,596, which is a continuation of application No. 10/367,649, filed on Feb. 14, 2003, now Pat. No. 7,153,244.

(51) Int. Cl.
*A63B 21/072* (2006.01)

(52) U.S. Cl. ..... 482/108; 482/93

(58) Field of Classification Search ..... 482/93, 482/106–109, 908
See application file for complete search history.

(56) References Cited

U.S. PATENT DOCUMENTS

| | | | | |
|---|---|---|---|---|
| 5,637,064 | A * | 6/1997 | Olson et al. | 482/108 |
| 5,667,464 | A * | 9/1997 | Simonson | 482/97 |
| 5,716,305 | A * | 2/1998 | Selsam | 482/93 |
| 5,769,762 | A * | 6/1998 | Towley et al. | 482/93 |
| 5,779,604 | A * | 7/1998 | Towley et al. | 482/108 |
| 5,879,274 | A * | 3/1999 | Mattox | 482/107 |
| 6,228,003 | B1 * | 5/2001 | Hald et al. | 482/107 |
| 6,261,022 | B1 * | 7/2001 | Dalebout et al. | 482/107 |
| 6,402,666 | B2 * | 6/2002 | Krull | 482/107 |
| 6,719,674 | B2 * | 4/2004 | Krull | 482/106 |
| 7,153,244 | B2 * | 12/2006 | Towley et al. | 482/108 |
| 7,387,596 | B2 * | 6/2008 | Towley et al. | 482/108 |
| 7,722,511 | B2 * | 5/2010 | Towley et al. | 482/108 |

OTHER PUBLICATIONS

Photographs showing prior Sport Block/ Personal set type dumbbell of the Applicants (undated but admitted prior art).

* cited by examiner

*Primary Examiner* — Fenn Mathew
(74) *Attorney, Agent, or Firm* — James W. Miller

(57) ABSTRACT

This invention relates to a selectorized dumbbell having a handle that can be dropped down between nested left and right stacks of weight plates. The weight plates can comprise individual weights or a pair of weight plates, one from each stack, can be connected together to form a single weight. A selector is provided to allow the user to select a desired number of weight plates from each stack and couple such weight plates to the handle to provide an adjustable weight dumbbell. Each weight includes a weight frame having at least one carrier to which a commodity weight can be fastened. The dumbbell can be shipped by the manufacturer with empty weight frames to reduce shipping costs. When the dumbbell with empty weight frames reaches a destination, the dumbbell can be completed by securing commodity weights to the carriers on the respective weight frames.

2 Claims, 7 Drawing Sheets

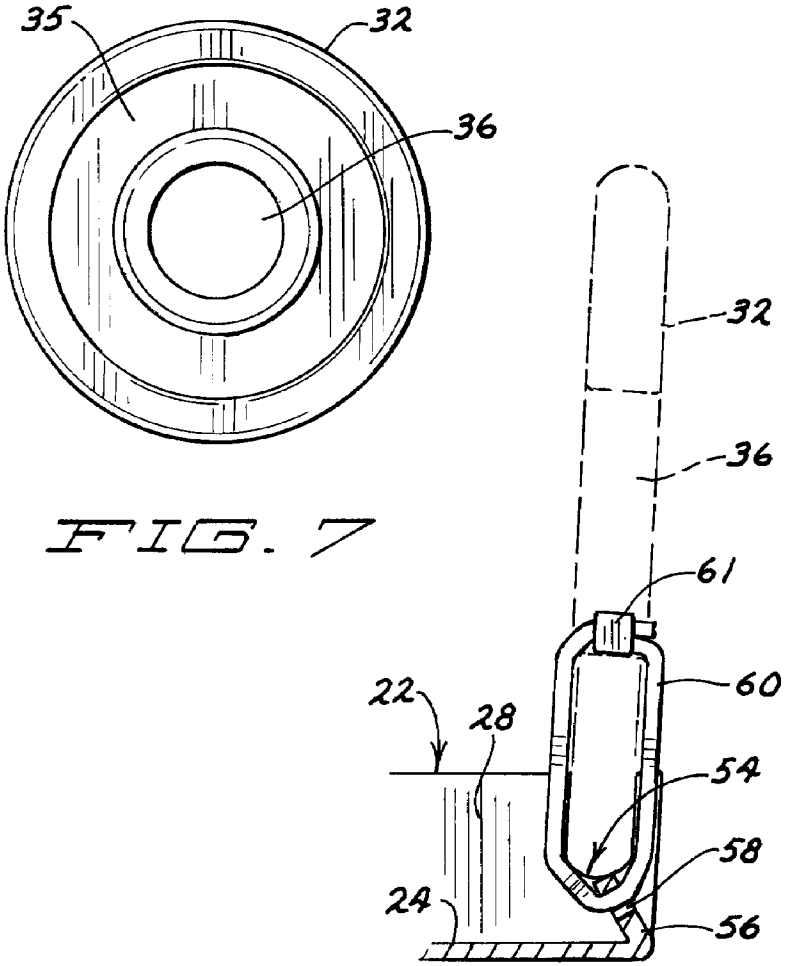
FIG. 7
FIG. 6
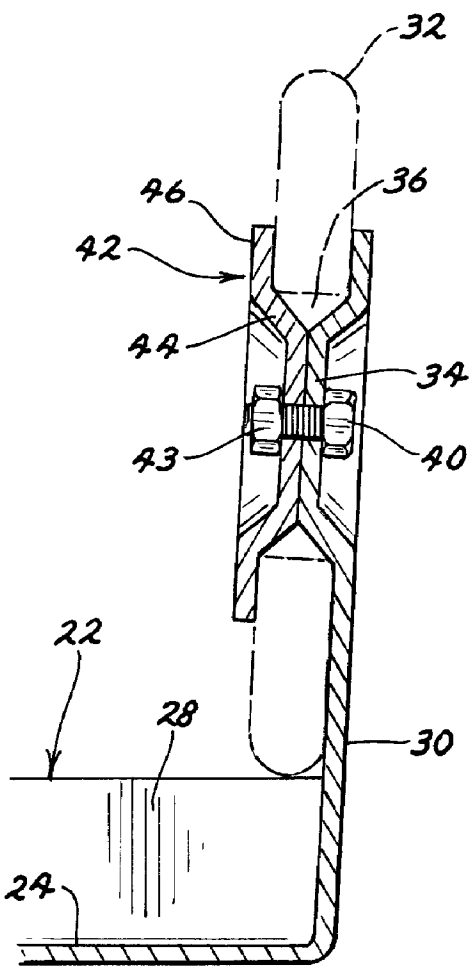
FIG. 5

SELECTORIZED DUMBBELL USING COMMODITY WEIGHTS

CROSS REFERENCE TO RELATED APPLICATIONS

This application is a continuation of application Ser. No. 12/214,265 filed Jun. 17, 2008, now U.S. Pat. No. 7,722,511, which is a continuation of application Ser. No. 11/644,061 filed Dec. 22, 2006, now U.S. Pat. No. 7,387,596, which is a continuation of application Ser. No. 10/367,649 filed Feb. 14, 2003, now U.S. Pat. No. 7,153,244.

TECHNICAL FIELD

This invention relates to a selectorized dumbbell having a selector that the user can manipulate to adjust the weight of the dumbbell. More particularly, this invention relates to a dumbbell using readily available commodity, cast iron weights in the manufacture thereof.

BACKGROUND OF THE INVENTION

The weight training field includes many machines sold under various names, such as Cybex, that are built to perform various weight training exercises. For example, in a Cybex weight training system, there might be one machine for doing a shoulder press exercise, another machine for doing a triceps press exercise, yet another machine for doing a biceps curl exercise, and so on. Each machine typically includes a stack of weights and a selector comprising an insertable pin that can be inserted beneath a particular weight in the stack. When the exercise is performed, it is performed against a resistance comprising all the weights in the stack that are located above the pin while the weights in the stack below the pin are left behind. By moving the pin to different positions in the stack, the user can adjust or vary the exercise mass.

The above described weight stack and pin structure is often referred to in the weight training art as a selectorized weight stack. The term "selectorized" means there is a selector which the user can manipulate to pick up and use a desired number of weights from the weight stack.

Selectorized dumbbells are known which comprise a set of weights located in two spaced apart stacks of weight plates. The weight plates in each stack can be separate from the weight plates in the other stack so that each weight plate forms a single weight. Alternatively, one weight plate in one stack can be joined to one weight plate in the other stack so that a single weight is formed by the pair of joined weight plates. In either of these designs, the weight plates in each stack are nested against one another with a gap or space being provided between the stacks of weight plates.

The selectorized dumbbell further comprises a handle that can be dropped down between the stacks of weight plates. At least one selector is provided to allow the handle to be coupled to a desired number of weight plates from each stack so that the desired number of weight plates are loaded from each stack onto either end of the handle. The selector can comprise a pin that is inserted beneath a selected weight or a movable selector carried on the handle that is slidable or rotatable relative to the handle to pick up different numbers of weight plates. The selector is manipulated by the user, e.g. by changing the position of the pin or by sliding or rotating the selector, to vary or adjust the amount of weight carried by the handle of the dumbbell.

After a weight adjustment operation is performed by the user, the user can pick up the dumbbell by lifting up on the handle of the dumbbell to lift the handle of the dumbbell, along with all the weight plates attached to either end of the handle, from between the remaining weight plates in each stack. The remaining or non-selected weight plates will simply remain in each stack in whatever stand or rack is provided for their storage. The user can then exercise with the dumbbell in a normal fashion. Following such exercise, the user can replace the handle of the dumbbell and the attached weights by dropping the dumbbell back into the space of gap formed between the remaining weights in the two stacks thereof.

One type of selectorized dumbbell is shown in U.S. Pat. No. 5,637,064 issued to the Applicants hereof. Other types of selectorized dumbbells are shown in U.S. Pat. Nos. 4,529,198, 6,149,558, 6,228,003 and 6,416,446.

Selectorized dumbbells have been manufactured with custom weight plates having a solid, plate-like form. In those selectorized dumbbells where the weight plates in the two stacks are joined together in pairs by connecting members such as side rails, the connecting members are often welded to the weight plates to form the connection. In those selectorized dumbbells where the weight plates in each stack comprise individual weights, it is not necessary to weld or attach pairs of weight plates to each other. Nonetheless, the weight plates again typically have a solid, plate-like form and must be provided with some type of means, such as a cut-out, a recess, a lobe, etc., that cooperates with the selector to allow the weight plate to be picked up and raised by the handle when the selector is positioned to select the weight plate. Thus, selectorized dumbbells when manufactured and shipped by the manufacturer are shipped as a complete unit, weights and all.

It is relatively expensive to ship selectorized dumbbells to a distributor, retailer or purchaser due to the weight of the dumbbell. In addition, shipping costs are expected to increase over time. Thus, there is a need in the art to provide a selectorized dumbbell which would be less costly to ship, but this need is inconsistent with the fact that such dumbbells as known in the art require custom manufactured weight plates as described above.

SUMMARY OF THE INVENTION

One aspect of this invention relates to a selectorized dumbbell which comprises a handle and a plurality of weights that can be nested together forming a nested first stack of weight plates and a nested second stack of weight plates. The first and second stacks of weight plates are separated by a gap that is large enough to accommodate at least a portion of the handle therebetween. A selector is movable by the user between different positions to allow a desired number of weight plates from each of the first and second stacks to be coupled to either end of the handle when the handle portion is located in the gap between the first and second stacks and the selector is manipulated by the user. Each weight comprises at least one weight plate. Each weight plate is removably attached to a carrier.

BRIEF DESCRIPTION OF THE DRAWINGS

This invention will be described more completely in the following Detailed Description, when taken in conjunction with the following drawings, in which like reference numerals refer to like elements throughout.

FIG. 5 is a cross-sectional view of a portion of the weight shown in FIG. 4, taken along lines 5-5 in FIG. 4, particularly illustrating the attachment of one of the commodity weights to the weight frame;

FIG. 6 is a cross-sectional view similar to FIG. 5, but illustrating another type of attachment for securing one of the commodity weights to the weight frame;

FIG. 7 is a top plan view of a typical commodity weight;

DETAILED DESCRIPTION

Figure 1:
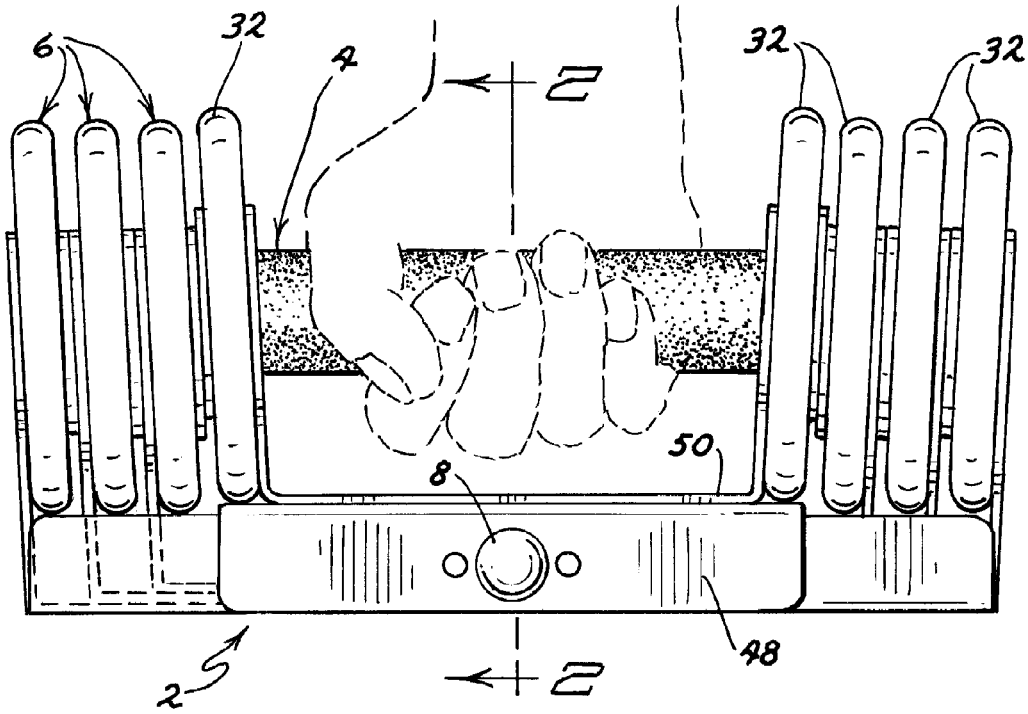
FIG. 1 is a side elevational view of a first embodiment of a selectorized dumbbell according to this invention.
Figure 2:
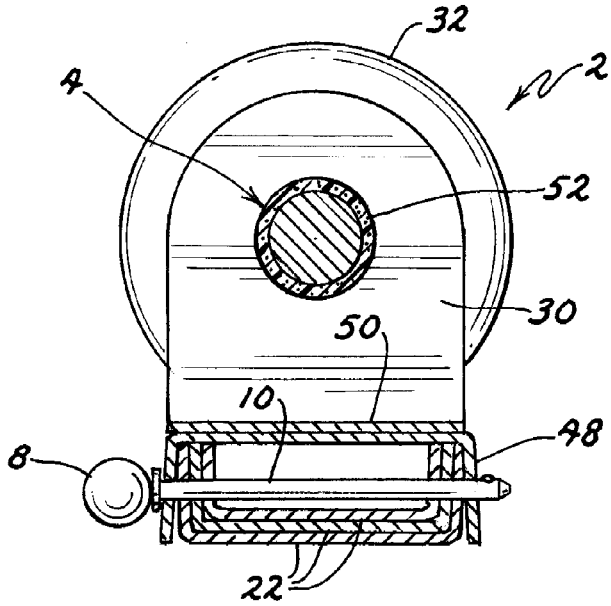
FIG. 2 is a cross-sectional view of the selectorized dumbbell of FIG. 1, taken along lines 2-2 in FIG. 1.

Referring first to FIGS. 1-5, a first embodiment of a selectorized dumbbell is illustrated generally as 2. Dumbbell 2 as shown herein is similar to an existing product known as the Big Block which is manufactured and sold by Intellbell, Inc. of Owatonna, Minn., and which is shown in the Applicants' U.S. Pat. No. 5,769,762, which is hereby incorporated by reference. A summary description of dumbbell 2 will be provided herein only as needed to understand this invention. Reference may be had to U.S. Pat. No. 5,769,762 for a fuller and more complete description of dumbbell 2.

Basically, dumbbell 2 includes a handle 4 and three nested weights 6 which can be selectively coupled to handle 4 using a selector 8, namely a pin 10 that can be moved between three different positions on handle 4 to pass through one of three holes 12 on handle 4. Weights 6 are provided with various sets of holes 14 and slots 16 in different combinations, a middle set c having three holes 14*c*, a far right set b having two holes 14*b* and one slot 16*b*, and a far left set a having two slots 16*a* and one hole 14*a*. See FIG. 3 which illustrates the various sets a-c of holes 14 and slots 16 in the various weights 6.

A desired number of weights 6 can be selectively coupled to handle 4 depending upon how selector 8 is used. If selector 8 is inserted through the middle hole 12 in handle 4 and through the middle set c of holes and slots, then all three weights 6 are coupled to handle 4. If selector 8 is inserted through the far left hole 12 in handle 4 and thus through the far left set a of holes and slots, then only one weight 6 is coupled to handle 4. If selector 8 is inserted through the far right hole 12 on handle 4 and thus through the far right set b of holes and slots, then two weights 6 are coupled to handle 4. If selector 8 is not inserted through any holes 12 on handle 4, then no weights 6 are coupled to handle 4 and handle 4 can be used by itself with the weight provided by handle 4 comprising the only exercise mass. The various sets a, b and c of holes and slots are further described in the Applicants' U.S. Pat. No. 5,769,762.

In dumbbell 2 of this invention, each weight 6 comprises an elongated weight frame 20 formed from an upwardly facing U-shaped channel 22 having a bottom wall 24 and front and rear walls 26 and 28. In addition, each channel 22 includes an upwardly extending carrier 30 at each end that extends well above channel 22. Carrier 30 is in the form of an upwardly extending tongue. See FIG. 4. Channel 22 and carriers 30 are formed of metal, such as steel, with carriers 30 being formed of extended portions of bottom wall 24 that are bent upwardly relative to channel 22. The various holes 14 and slots 16 in each set a, b and c thereof are duplicated in the opposed front and rear walls 26 and 28 of channel 22 as taught in the Applicants' U.S. Pat. No. 5,769,762.

A pair of commodity weights 32 are secured to carriers 30 of weight frame 20, with one weight 32 being secured to each carrier 30. In this regard, each carrier 30 includes a hub 34 that is punched out of each carrier 30 at the top of carrier 30. Hub 34 sticks inwardly relative to carrier 30 to point towards the interior of weight frame 20. Hub 34 is sized to be received in a central hole 36 of commodity weight 32. Hub 34 also includes a hole 38 at the center of hub 34 to allow an attachment bolt 40 to pass therethrough.

A clamping member 42 is used on the other side of commodity weight 32 to clamp or secure commodity weight 32 on hub 34 of carrier 30 when attachment bolt 40 is tightened by a nut 43. Clamping member 42 includes a protruding, saucer shaped central portion 44 and an annular peripheral rim 46 surrounding central portion 44.

FIG. 5 shows hub 34 on carrier 30 passing into central hole 36 on commodity weight 32. Saucer shaped portion 44 of clamping member 42 passes into central hole 36 on commodity weight 32 opposite to hub 34 to be able to abut and mate with hub 34. Attachment bolt 40 passes through both clamping member 42 and hub 34 to firmly clamp the clamping member 42 to hub 34 when nut 43 is tightened. When so clamped, commodity weight 32 is held in the annular channel formed between peripheral rim 46 of clamping member 42 and the portions of carrier 30 surrounding hub 34. Thus, a commodity weight 32 may be easily clamped to each carrier 30 of weight frame 20 using hub 34 provided on carrier 30 and a clamping member 42.

FIG. 7 illustrates a typical commodity weight 32 of the type that is often used on traditional barbells or dumbbells. In such traditional barbells or dumbbells, a simple bar is used and a plurality of separate commodity weights 32 are provided. Each commodity weight 32 comprises a circular weight plate 35 having a central hole 36. Hole 36 in commodity weight 32 allows commodity weight 32 to be slipped over one end of the bar. After a desired number of weights 32 have been so installed on each end of the bar, weights 32 can be held in place by a locking collar that is then placed and secured on each end of the bar.

In using traditional barbells or dumbbells of this type, the user adjusts the exercise mass by loosening and removing the locking collars from the ends of the bar and by then removing weights 32 from each end of the bar or by adding additional weights 32 to the bar. Each gym has a number of such weights 32 on hand simply for use on a bar to add weight to the bar. Weights 32 are referred to herein as "commodity weights" since they are a low cost commodity product typically manufactured in low wage, developing countries, such as China. Weights 32 are cast in large quantities from iron, currently more than 10 million pounds per year. They are shipped in large quantities from their country of origin and are readily available all around the world in standard weights, such as 1.25 pounds, 2.5 pounds, 5 pounds, and so on.

The Applicants have discovered that commodity weights 32 of this type are so inexpensive that the cost to purchase the weights locally is not much more or about the same as the cost to ship the same weights from the United States. Moreover, as shipping costs rise, the costs to ship relatively heavy dumbbells is expected to increase.

Accordingly, in a preferred method of manufacturing dumbbell 2, weight frames 20 would be manufactured and shipped as part of dumbbell 2 but without any commodity weights 32 being attached thereto. The distributor, retailer or purchaser of the product would receive dumbbell 2 in this "unweighted" form. The distributor, retailer or purchaser of the product would then purchase a sufficient number of commodity weights 32 locally wherever the distributor, retailer or purchaser resides and would add such weights 32 to each weight frame 20 to complete dumbbell 2. In this regard, dumbbell 2 would be shipped with enough clamping members 42, bolts 40 and nuts 43 to allow a sufficient number of commodity weights 32 to be clamped to all the different weight frames 20 to complete dumbbell 2.

The net result of this preferred manufacturing method of this invention is a lower cost product in the hands of the end user. The cost to purchase the product by the end user will be reduced by the costs that would have been incurred to manufacture or purchase custom weight plates as well as by the costs to ship all of the weights. This cost reduction will more than offset the cost at the other end to complete dumbbell 2 by having to purchase a sufficient number of commodity weights 20. Essentially, at least the shipping costs that are usually associated with shipping the dumbbell should by and large be saved. This is an advantage to the user of dumbbell 2 by lowering the cost to own dumbbell 2.

In addition, commodity weights 32 of different weights, such as 1.25 pounds or 2.5 pounds, typically have smaller diameters but a central hole 36 that is the same diameter to allow each weight 32 to be slipped onto the bar of a conventional barbell or dumbbell. Thus, the user can determine the incremental amount of adjustability for dumbbell 2 by selecting which sized commodity weight 32 to attach to carriers 30. If a 1.25 pound commodity weight 32 is attached to carriers 30, then dumbbell 2 will adjust in 2.5 pound increments. If a 2.5 pound commodity weight 32 is attached to carriers 30, then dumbbell 2 will adjust in 5 pound increments. In addition, dumbbells 2 constructed with lighter commodity weights 32 will be dimensionally smaller in height and width than dumbbells 2 constructed with heavier commodity weights 32.

Using commodity weights 32 to complete dumbbell 2 gives the end user a great deal of flexibility in custom tailoring dumbbell 2 to the user's desires. If a user wants a smaller, lighter dumbbell 2 that adjusts in smaller increments, the user completes dumbbell 2 with lighter commodity weights 32. If a user wants a larger, heavier dumbbell 2 that adjusts in larger increments, the user completes dumbbell 2 with heavier commodity weights 32. Moreover, the user can upgrade dumbbell 2 from a lighter to a heavier version simply by replacing the currently used commodity weights 32 with heavier commodity weights 32 without having to buy a set of new weight frames 20.

Commodity weights 32 of the same size are available in slightly different thicknesses. For example, 2.5 pound weights 32 are currently made in 50 or so different foundries worldwide and vary in thickness from 0.565 inches to 0.615 inches. Weight frames 20 have to be manufactured to accommodate the thickest weight 32 in a particular size or range of sizes that are intended for use on weight frames 20. In other words, clamping member 42 has to clamp to hub 34 and be able to receive the thickest commodity weight 32. A compressible foam washer or other material could be supplied to use with thinner weights 32 to take up any play or gaps between thinner weights 32 and clamping member 42.

Figure 3:
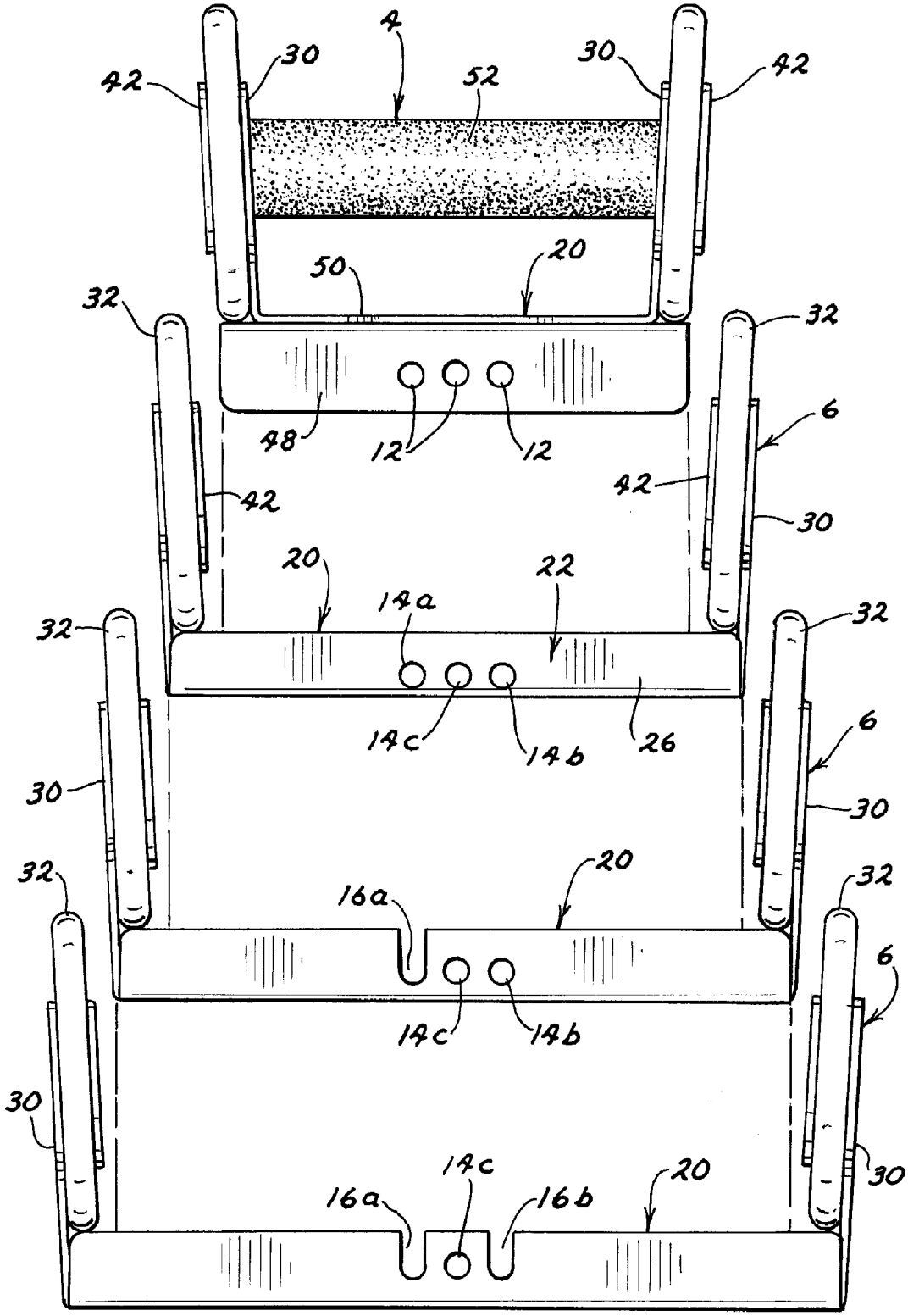
FIG. 3 is a side elevational view of the selectorized dumbbell of FIG. 1, shown in exploded form to illustrate the handle of the dumbbell and the various weights that can be attached to the handle of the dumbbell.
Figure 4:
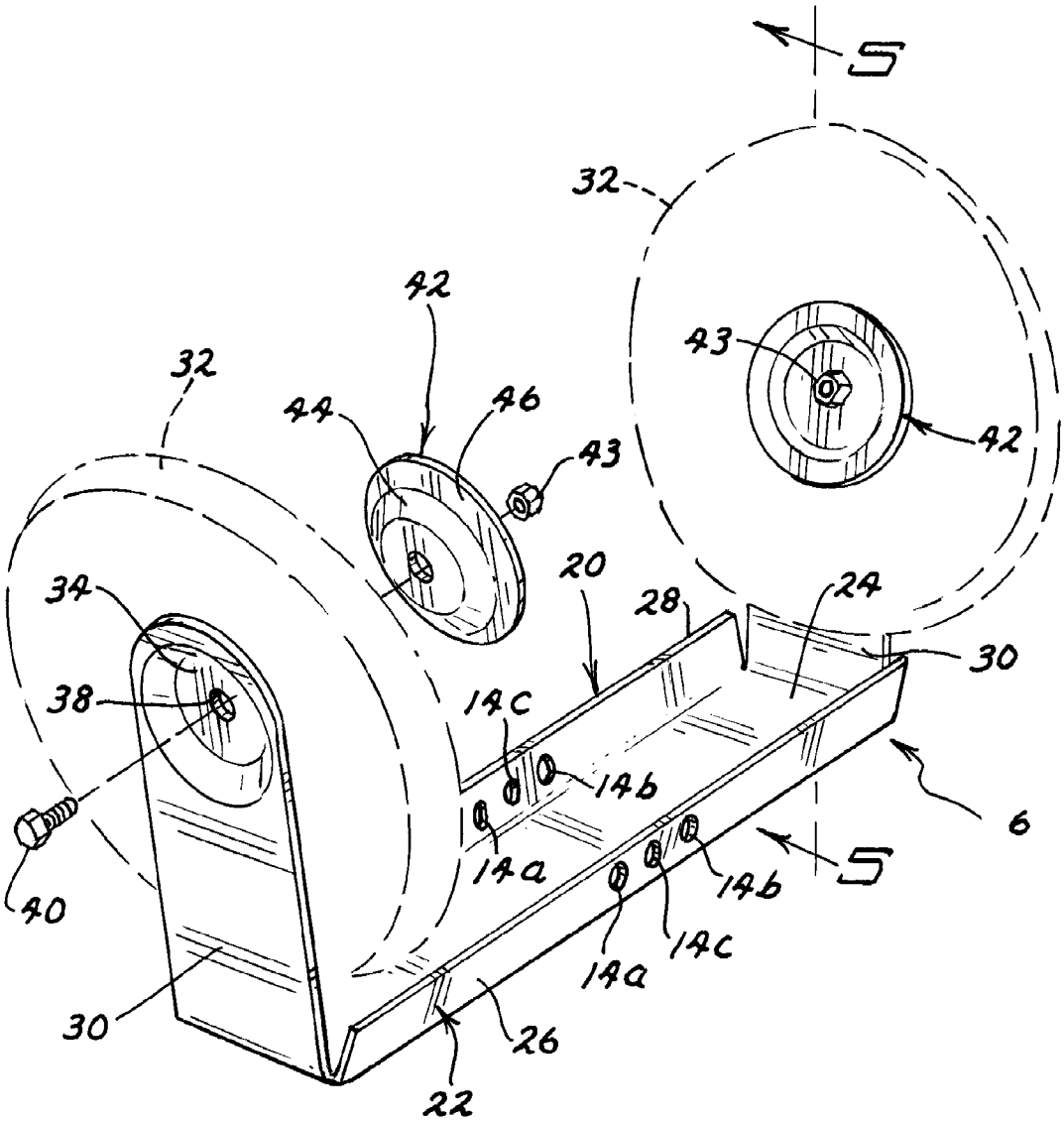
FIG. 4 is a perspective view of one of the weights used with the selectorized dumbbell of FIG. 1, particularly illustrating the attachment of the commodity weights to the weight frame.

Handle 4 of dumbbell 2 is shown in FIGS. 1-5 as having a pair of commodity weights 32 secured to either end thereof. In the case of handle 4, weight frame 20 includes a downwardly facing U-shaped channel 48 instead of an upwardly facing U-shaped channel 22. An upwardly facing U-shaped cradle 50 having spaced apart carriers 30 is fixed to the upper surface of downwardly facing channel 48. A hand grip 52 extends between carriers 30 as shown in FIGS. 1 and 3. Hand grip 52 carries a resilient cushion or cover to allow the user to better grip hand grip 52 of handle 4.

In the case of handle 4, carriers 30 will be formed with outwardly, rather than inwardly, extending hubs 34 which are inserted into central holes 36 of weights 32. A similar clamping member 42 is used on the outside of carrier 30 to clamp weight 32 to carrier 30. Instead of a bolt 40 and nut 43 for tightening clamping member 42 to hub 34, a machine screw is used which can be screwed into a threaded bore (not shown) in the end of hand grip 52 to tighten clamping member 42 on carrier 30 of handle 4. Thus, handle 4 can itself be provided with a pair of commodity weights 32 to allow handle 4 to be used for exercise by itself without any weights 6 being coupled to handle 4 by selector 8.

Alternatively, handle 4 could be formed without any provision for coupling any commodity weights 32 to handle 4. In this case, carriers 30 of handle 4 could simply be planar and solid without any outwardly protruding hub 34 for mounting a weight 32. In this configuration, at least one weight 6 would normally be coupled to handle 4 to provide a minimum exercise mass. The exercise mass would be adjusted by selectively coupling additional weights 6 to handle 4 using selector 8.

Other ways of coupling weights 32 to each end of weight frame 20 could be used. FIG. 6 shows one such alternative coupling.

Referring to FIG. 6, each end of upwardly facing channel 22 of each weight frame 20 is no longer provided with an upwardly extending carrier 30. Instead, each front and rear wall 26 and 28 of channel 22 is provided with a vertical slot 54 sized to receive the thickness of commodity weight 32 within slot 54. Bottom wall 24 of channel 22 includes a tang 56 having a hole 58 in the top end of tang 56. A flexible tie 60 is used to tie weight 6 in place in channel 22 with tie 60 passing through hole 58 in tang 56 and encircling the lower side of weight 32 with tie 60 being secured to itself by a connector 61 within central hole 36 of weight 32. Such flexible ties 60 and connectors 61 as well as the tools used to secure the ends of tie 60 together at connector 61 are well known in the fastener art.

FIGS. 8-12 show an alternative form of selectorized dumbbell 2' according to this invention. The type of dumbbell 2' shown in FIGS. 8-12 is similar to an existing product known as the Power Block, which is manufactured and sold by Intellbell, Inc. of Owatonna, Minn., and which is shown in the Applicants' U.S. Pat. No. 5,637,064, which is hereby incorporated by reference. A summary description of dumbbell 2' will be provided herein only as needed to understand this invention. Reference may be had to U.S. Pat. No. 5,637,064 for a fuller and more complete description of dumbbell 2'.

Basically, dumbbell 2' includes a handle 4' and a plurality of nested weights 6' which can be selectively coupled to handle 4' using a selector 8'. In the dumbbell 2', each weight 6' includes a pair of spaced apart weight plates 70 that are rigidly joined together by a pair of side rails 72. Beginning with the innermost weight 6', each weight 6' has the weight plates 70 spaced apart a progressively greater distance and the side rails 72 located progressively lower to allow the weights 6' to be nested together. The selector 8' comprises a double pronged pin which can be slid beneath the side rails 72 of a selected weight 6' by sliding the prongs of the pin into a selected groove 74 on each end of handle 4'. With selector 8' so positioned, when the user lifts up on handle 4', all weights 6' whose side rails 72 are above selector 8' will be lifted with handle 4'.

In the dumbbell 2' as shown in the 064 patent, the individual weights 6' were manufactured by taking two custom made weight plates 70 and by welding the side rails 72 to either side of the weight plates. In the embodiment of dumbbell 2' of this invention as shown in FIGS. 8-12, each weight 6' is now made as a relatively lightweight weight frame 20' that removably accept and retain a pair of commodity weights 32. Thus, each weight 6' when completed will comprise a weight frame 20' with a commodity weight 32 in either end of weight frame 20'.

Each weight frame 20' for each weight 6' comprises a pair of planar, generally vertical carriers 30' that are spaced apart the required distance to allow weight 6' to be nested with the other weights 6'. Carriers 30' are preferably molded or formed as a single piece out of a lightweight material, such as plastic. Each carrier 30' has downwardly facing shoulders 64 along either side. Shoulders 64 of adjacent weights 6' are at progressively lower elevations as shown in FIG. 8, again to allow the completed weights 6' to nest together.

Figure 11:
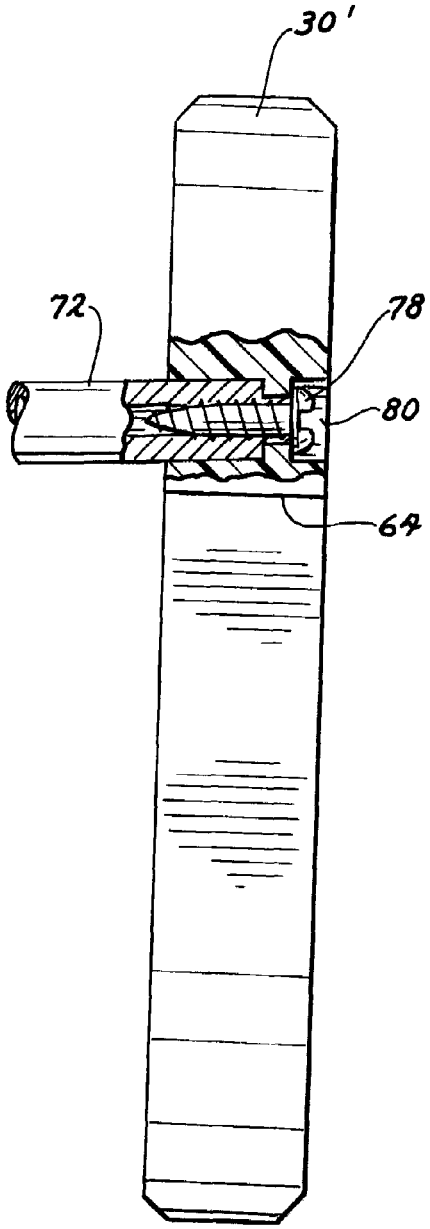
FIG. 11 is a partial cross-sectional view of a portion of the weight frame of dumbbell 2 of FIG. 8, taken along lines 11-11 in FIG. 9.

Carriers 30' are rigidly connected together by a pair of connecting rods or side rails 72, preferably made of metal for durability. As shown in FIG. 11, the end of each side rail 72 is simply bolted or screwed to shoulder 64 of the carrier by a screw or bolt 78. The head of screw or bolt 78 is received in a recess 80 in carrier 30' so that screw or bolt 78 does not protrude beyond the face of carrier 30'. When each end of side rail 72 is screwed to shoulders 64 on the same side of both carriers 30', side rail 72 will extend between and unite the two carriers 30' together in much the same way as the welded side rails joined the pair of weight plates shown in the 064 patent. There are two such side rails 72 for each weight 6', one on either side of carrier 30', uniting shoulders 64 provided on each side of carrier 30'.

Figure 8:
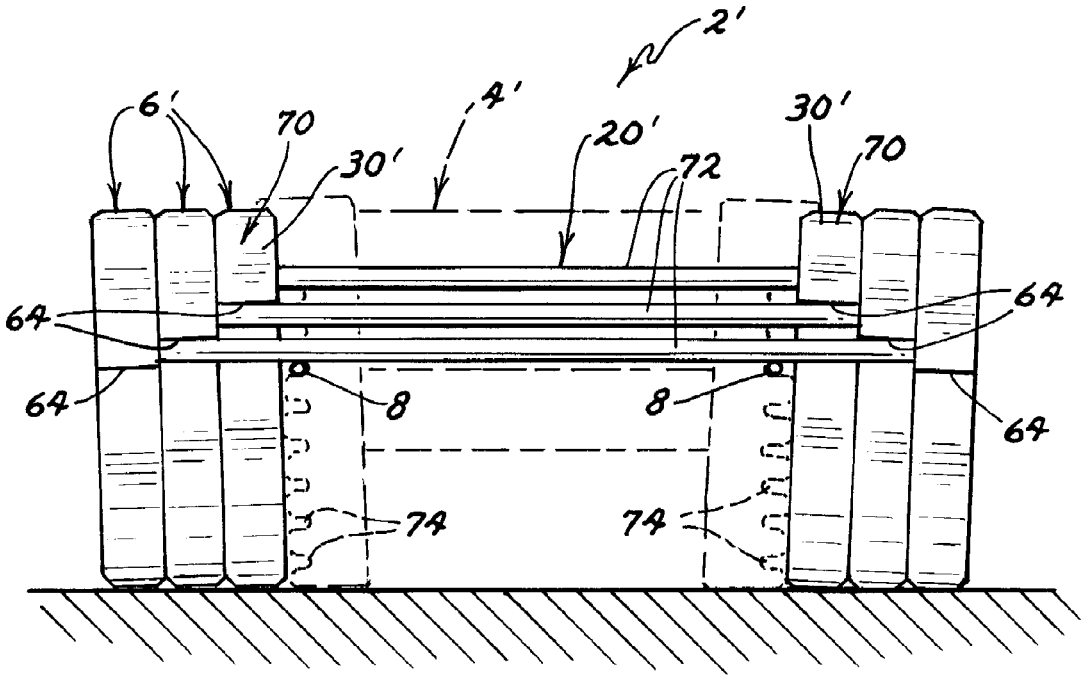
FIG. 8 is a side elevational view of a second embodiment of a selectorized dumbbell according to this invention.
Figure 9:
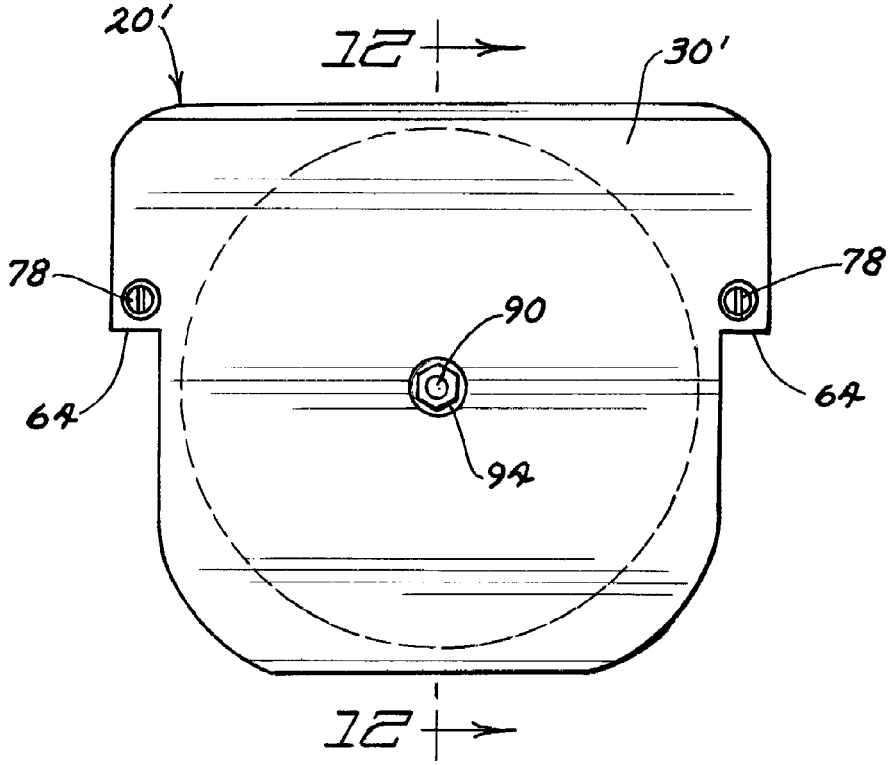
FIG. 9 is an end elevational view of dumbbell 2 of FIG. 8.

The need for shoulders 64 that are progressively lower on adjacent weights is to allow side rails 72 to nest beneath one another as shown in FIG. 8. While three weights 6' have been shown in FIG. 8, more could be provided with weights 6' lying progressively outside of the three weights 6' that are shown with such additional weights 6' having progressively lower shoulders 64 and side rails 72. As many weights 6' could be provided as there are grooves 74 in each end of handle 4, grooves 74 being suited for holding selector 8' at different levels to couple different numbers of weights 6' to handle 4'.

Each carrier 30' includes a cavity 84 for receiving one commodity weight 32 therein. As shown most clearly in FIG. 10, cavity 84 is provided in an inner face of carrier 30' and is circular in shape. Cavity 84 includes a central, cylindrical hub 86 that is sized to be received within central hole 36 of commodity weight 32. Hub 86 includes a central bore 88 for receiving a fastener 90 such as a bolt. Cavity 84 is deep enough to accommodate the thickest weight 32 in a size or range of sizes intended to be used on carriers 30'. Again, foam washers or rings or other material could be used in cavity 84 around hub 86 to accommodate any play if thinner weights 32 are used. Dumbbell 2' as shown herein, when completed with commodity weights 32, will desirably have a snug fit of commodity weights 32 in cavity 84 to avoid excess rattling and clanking and to impart a feeling of quality and safety to the end user.

Figure 10:
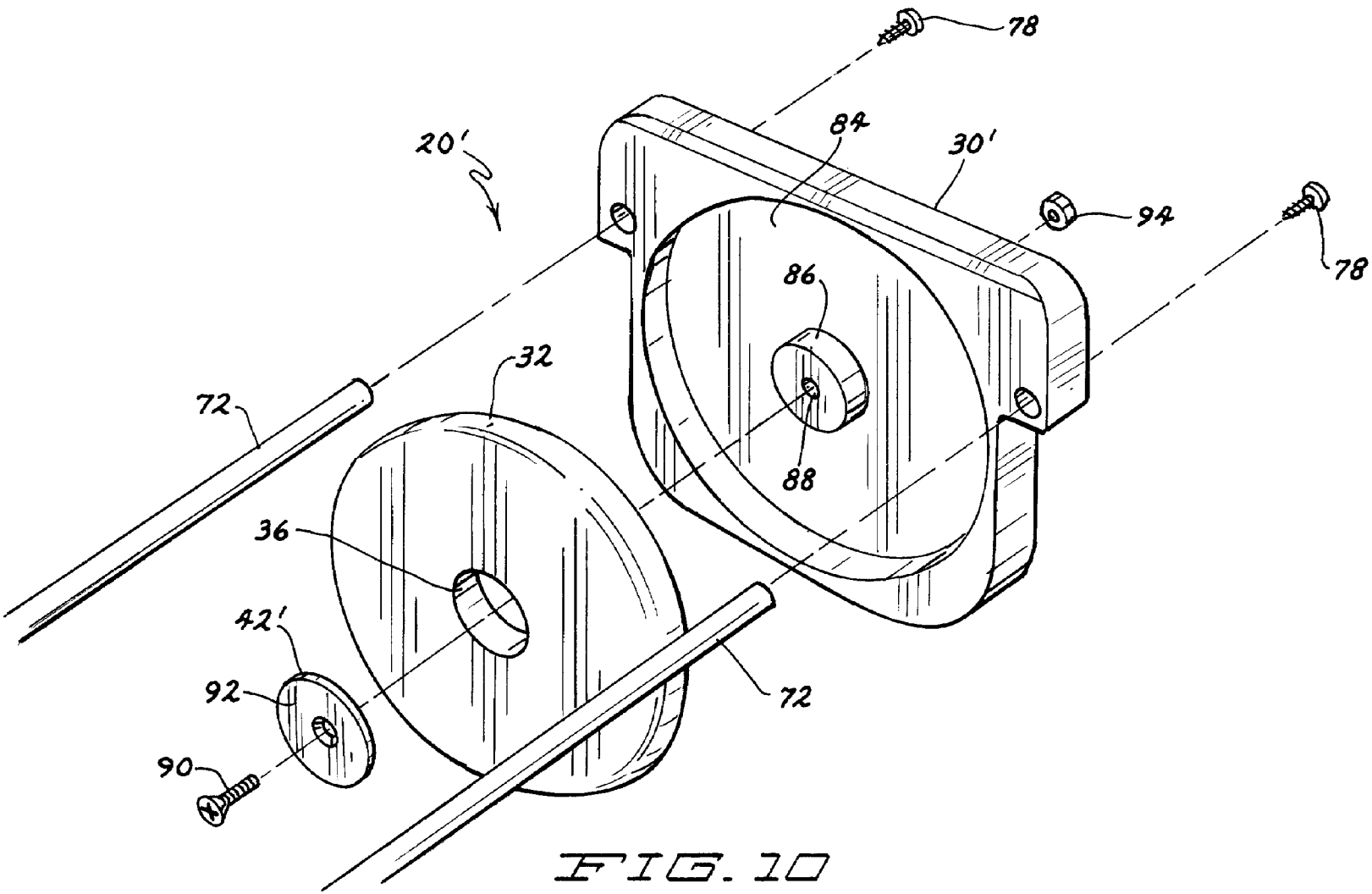
FIG. 10 is a partial perspective view in exploded form of one end of dumbbell 2 of FIG. 8, particularly illustrating portions of the weight frame and the attachment of a commodity weight to one end of the weight frame.

Referring further to FIG. 10, a commodity weight 32 is attached to carrier 30' simply by lying weight 6 into cavity 84 with central hole 36 of weight 32 being concentrically received around the cylindrical central hub 86 in cavity 84. A clamping member 42', such as a flat washer 92, is then abutted against the inner side of commodity weight 32. Bolt 90 can be inserted through washer 92, through central hole 36 in commodity weight 32, and through central bore 88 of hub 86. A nut 94 can be tightened on the free end of bolt 90 to tighten and clamp washer 92 against commodity weight 32 to hold commodity weight 32 in place in cavity 94.

Figure 12:
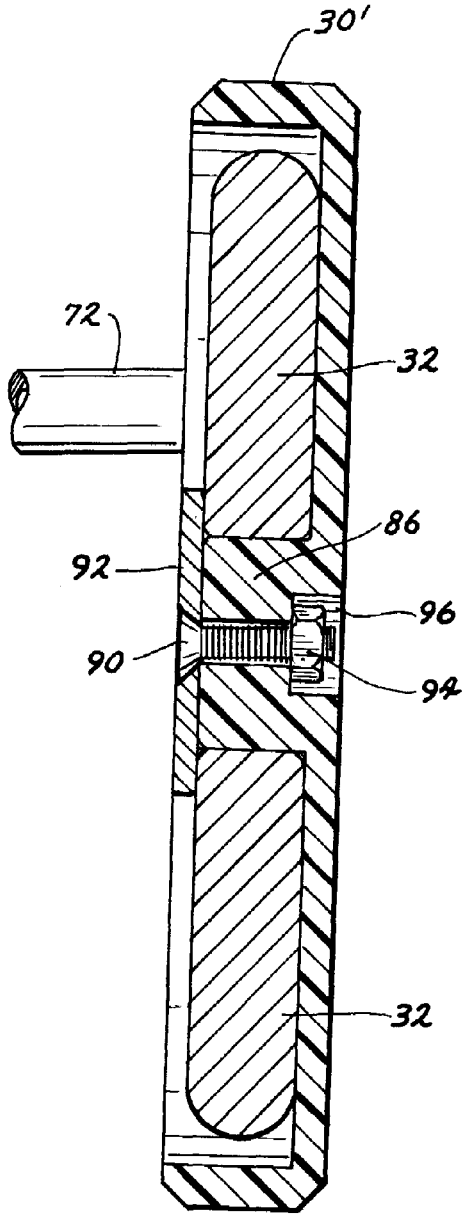
FIG. 12 is a cross-sectional view of a portion of the weight frame of dumbbell 2 of FIG. 8, taken along lines 12-12 in FIG. 9, particularly illustrating the attachment of a commodity weight to a portion of the weight frame.

Referring to FIG. 12, when commodity weight 32 is assembled to carrier 30' in this fashion, the combined thicknesses of the various parts does not exceed the thickness of carrier 30' to allow proper nesting of the various weights 6' against one another. For example, nut 94 is received in a recess 96 in carrier 30' so that it does not protrude beyond the adjacent face of carrier 30'. When tightened, washer 92 is flush or slightly inside of the other face of carrier 30'. Thus, each carrier 30' on each weight 6' can be abutted flush against the carriers 30 on the adjacent inside and outside weights 6' in the nested array of weights 6'.

If nut 94 or bolt 90 should become loose, the fact that cavity 84 is in the inner face of carrier 30' is beneficial. Weight 32 will still be trapped or retained between carrier 30' and the outer face of carrier 30' on the adjacent weight frame 20' lying to the inside. This enhances safety of dumbbell 2'.

The alternative embodiment of a selectorized dumbbell 2' as disclosed in FIGS. 8-12 has the advantages of the previous embodiment in that it can be completed by using readily available, low cost commodity weights 32. Thus, dumbbell 2' can also be shipped by the manufacturer with handle 4', the various weight frames 20' of the different weights 6', selector 8', and the necessary clamping washers 92, bolts 90 and nuts 94. Once dumbbell 2' reaches a destination in the hands of a distributor, retailer or purchaser, it can be completed by purchasing the required number of commodity weights 32 locally and by clamping each commodity weight 32 in a cavity 94 of one carrier 30'. Following completion in this manner, dumbbell 2' is ready for use in the normal method. The result is a dumbbell that is less expensive to manufacture and for the user to purchase.

Various modifications of this invention will be apparent to those skilled in the art. For example, the use of commodity weights 32 is not limited to selectorized dumbbells 2, 2' as shown herein, but could be used in any selectorized dumbbell including selectorized dumbbells where the selector is simply a movable part on the handle that cooperates with a recess, detent, cam lobe, etc. on each weight. In this event, the weights can still be manufactured as a weight frame that will receive a commodity weight 32 with commodity weight 32 supplying the mass that is needed as long at the weight frame carries the recess, detent, cam lobe, etc. that is required for cooperation with the selector.

Moreover, while the Applicants believe that it is most advantageous to purchase and unite commodity weights 32 to weight frames 20, 20' after weight frames 20, 20' are first shipped by the manufacturer to another destination, this is not necessary for every aspect of this invention. Weights 32 could be added to weight frames 20, 20' prior to shipment by the manufacturer as this still permits using readily available, low cost commodity weights 32 in the manufacture of selectorized dumbbells 2, 2'.

Low cost, cast iron commodity weights manufactured for use on traditional barbells or dumbbells are a preferred type of commodity weight that can be used with respect to dumbbells 2, 2'. However, large and heavy steel washers which are also readily available and relatively low cost can also comprise commodity weights 32.

Thus, the scope of this invention is to be limited only by the appended claims.

We claim:

1. A selectorized dumbbell, which comprises:

(a) a plurality of individual weights that can be nested together to provide a left stack of nested left weight plates and a right stack of nested right weight plates that are separated by a gap;

(b) a handle that may be dropped down into the gap between the stacks of nested left and right weight plates;

(c) a selector that connects a desired number of weights to the handle; and (d) wherein each weight comprises:

(i) a left weight plate and a right weight plate that are spaced apart but joined to one another by a horizontal front rail extending between front sides of the weight plates and a horizontal rear rail extending between rear sides of the weight plates, the weight plates and front and rear rails of each weight being separate and distinct from the weight plates and front and rear rails of the other weights and from the handle, wherein the front and rear rails of any given weight are located at a constant vertical elevation relative to one another with the front and rear rails of different weights being located at different vertical elevations relative to one another such that the front and rear rails of all the weights overlie one another in vertically spread apart front and rear rail arrays, and wherein the front and rear rails of each weight differ in length from the front and rear rails of the other weights such that the weight plates of different weights are spaced apart at progressively greater distances, wherein the different elevations and different lengths of the front and rear rails on different weights allow the left and right weight plates to be nested with respect to one another in their respective left and right stacks;

(ii) wherein each left and right weight plate of each individual weight comprises a metallic inner weight plate and a non-metallic carrier that at least partially surrounds and encases the inner weight plate;

(iii) wherein the non-metallic carrier of each left and right weight plate of each individual weight includes a front downwardly facing shoulder on a front side of the carrier and a rear downwardly facing shoulder on a rear side of the carrier with the front and rear downwardly facing shoulders being integrally formed with the non-metallic carrier such that the downwardly facing front and rear shoulders and non-metallic carrier comprise a single part, wherein the front and rear downwardly facing shoulders on the carriers of the separated left and right weight plates of any given weight are at a constant vertical elevation relative to one another, and wherein the front and rear downwardly facing shoulders on the carriers of the separated left and right weight plates of different weights are at progressively lower vertical elevations relative to one another as the left and right weight plates of the different weights are spaced apart at progressively greater distances relative to one another; and (iv) wherein opposite ends of each front rail of any given weight are removably connected by removable fasteners to the carriers of the given weight above the front downwardly facing shoulders on the carriers and opposite ends of each rear rail of the given weight are removably connected by removable fasteners to the carriers of the given weight above the rear downwardly facing shoulders, wherein the front and rear rail fastener connections of any given weight to the carriers of the given weight are sufficiently close to the downwardly facing shoulders on the carriers such that that front and rear rails of the given weight pass beneath and nest below the downwardly facing shoulders on the carriers of an immediately adjacent inboard weight.

2. The selectorized dumbbell of claim 1, wherein the removable fasteners are threaded fasteners that are removably received in threaded bores in the opposite ends of the front and rear rails.

* * * * *